United States Patent [19]

Childers

[11] 4,327,719

[45] May 4, 1982

[54] NOSE FILTER

[76] Inventor: Irene J. Childers, Rte. 3, Box 325, Dandridge, Tenn. 37725

[21] Appl. No.: 216,261

[22] Filed: Dec. 15, 1980

[51] Int. Cl.[3] ..... A62B 7/10

[52] U.S. Cl. ..... 128/206.11; 128/203.22

[58] Field of Search ..... 128/206.11, 203.22, 128/204.12

[56] References Cited

U.S. PATENT DOCUMENTS

| | | | |
|---|---|---|---|
| 855,573 | 6/1907 | Heath | 128/206.11 |
| 2,433,565 | 12/1947 | Korman | 128/206.11 |
| 2,715,401 | 8/1955 | Appel | 128/206.11 |

FOREIGN PATENT DOCUMENTS

| | | | |
|---|---|---|---|
| 1191820 | 4/1959 | France | 128/206.11 |
| 49187 | 3/1910 | Switzerland | 128/203.22 |

*Primary Examiner*—Henry J. Recla

*Attorney, Agent, or Firm*—Pitts & Kesterson

[57] ABSTRACT

A nose filter for filtering air breathed through the nostrils is provided. The nose filter includes a first nostril unit and a second nostril unit which anatomically engage the nostrils of the user such that one unit extends into each of the user's nostrils. Each nostril unit includes a holder which carries a filter member through which air is inhaled. The filter member is held in position by a filter plug member fabricated from a resilient material which extends into the nostril passageway and anatomically engages the septum and nostril wall. The nostril units are secured together at a spaced location by a securing device which biases each of the units against opposite walls of the nose septum such that the nose filter position is fixed.

8 Claims, 7 Drawing Figures

NOSE FILTER

DESCRIPTION

Technical Field

This invention relates to a nose filter and more particularly concerns a filter through which air is inhaled by a user such that particulate matter is trapped by the filter member during breathing.

Background Art

Almost all persons live or work in locations having air pollution, microorganisms, pathogens or other particles entrained in the ambient air. Such particles may be injurious to the health of the breather. For example, allergy patients are exposed to various pollens during certain periods of the year and certain pollens may cause violent allegic reactions within the body of the exposed person. Moreover, persons working in various medical professions, mining, or other occupations are continuously exposed to particulate material entrained in the ambient atmosphere which is inhaled into the respiratory system during breathing.

Heretofore, it has been known that nose filters could assist in trapping particulate material entrained in the ambient atmosphere to assist in preventing such material from being taken into the lungs. Certain of the prior art devices are illustrated in the following U.S. Pat. Nos. 3,451,392; 3,463,149; and 3,457,917. The known prior art, however, suffers certain disadvantages. For example, certain of the known nose filters require specially manufactured filter members which may or may not be replaceable in the mounting devices. Also, certain of the known nose filters are expensive to manufacture and assemble. It has also been a problem to design a nose filter which can be universally utilized for nostrils of various sizes.

Accordingly, it is an object of this invention to provide a nose filter which can be inexpensively manufactured and which incorporates an universal fit feature. A further object of the invention is to provide a nose filter having a filter member which can be readily replaced after contamination, and to adapt the nose filter for filtering various types of particulate material from the ambient atmosphere prior to its being inhaled. Yet another object of the invention is to provide a nose filter which is comfortable to the user and forms a seal with the nose, and particularly the brim of the nose, such that substantially all of the air inhaled by the user passes through the filter medium where the particulate material is entrapped by the filter.

DISCLOSURE OF THE INVENTION

In accordance with various features of the invention, the nose filter is provided which is adapted for filtering air breathed through the nostrils. The filter includes a first nostril unit and a further nostril unit. Each of the nostril units are mounted within one of the nostrils of the user to filter air inhaled through the restricted nostril. Each nostril unit includes a holder which defines a bore therethrough and includes one end portion which is provided with an annular shoulder. A filter member which has a cross-sectional outline approximately equal to the cross-sectional outline of the holder bore is mounted within the holder such that the perimeter of the filter member rests on the annular shoulder. A filter plug member having a generally cylindrical outline defines a passageway therethrough and includes one end portion which is proportioned for being received within the holder to secure the filter member. The filter plug member of each of the nostril units is inserted into and received by the nostril passage and anatomically engages the nostril wall and the septum of the user. Securing means are provided for joining the first nostril unit with the further nostril unit and serves to bias each of the nostril units in a direction for anatomically engaging the septum. Preferably, the filter plug member includes an external wall which is contoured for receiving the brim of the nose and the septum for purposes of forming a seal therewith and for purposes of assisting in positioning the filter within the nose of the user.

BEST MODE FOR CARRYING OUT THE INVENTION

Figure 1:
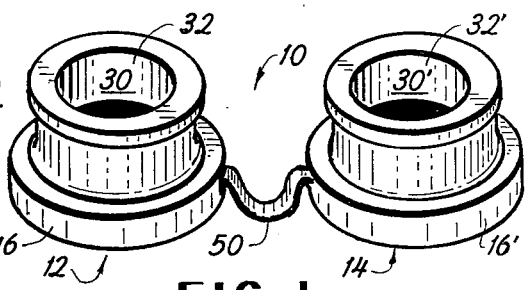
FIG. 1 illustrates a perspective view of a filter constructed in accordance with various features of the invention.

Referring now to the drawings a nose filter constructed in accordance with various features of the invention is illustrated generally at 10 in FIG. 1. The illustrated nose filter is constructed such that it can be inexpensively produced in plastic molds, or the like, and provides a substantially universal fit feature such that the filter can be received in noses of various sizes.

The filter 10 includes a pair of nostril units indicated at 12 and 14 respectively. The components of each of the nostril units 12 and 14 are substantially identical and accordingly primed numerals of the nostril unit 14 will correspond with the like numerals of the nostril unit 12.

Figure 4:
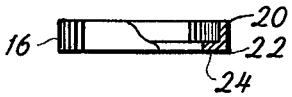
FIG. 4 illustrates a elevation view of a filter holder with a portion of the holder broken away.
Figure 5:
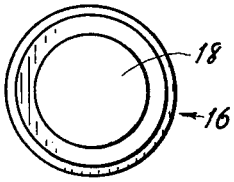
FIG. 5 illustrates a plan view of the holder illustrated in FIG. 4.

The nostril unit 12 includes a holder 16 having a substantially cylindrical configuration with a bore 18 which extends therethrough. This holder defines an upper end portion generally indicated at 20 in FIG. 4 and a lower end portion 22. This lower end portion of the holder defines an annular shoulder section illustrated in FIG. 4 such that the bore 18 has a reduced cross-sectional outline or diameter at the location of this shoulder 24.

Preferably, the holders 16 and 16' of each of the nostril units is fabricated from a semi-rigid material. For example, the holders in one embodiment are fabricated from a plastic which can be readily molded in large quantities to reduce the cost of the filter manufacturing process.

Figure 3:
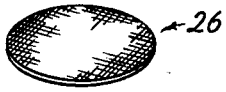
FIG. 3 illustrates a sample filter member suitable for being received in the filter holder illustrated in FIG. 1.

A filter member generally indicated at 26 in FIG. 3 is secured by each of the holders 16 and 16'. This filter member 26 comprises a fibrous material in one embodiment which enables inhalation of the ambient atmosphere therethrough. The spacing of the fibers is preselected such that the filter member will trap pollen or other particulate matter passing therethrough during the user's inhalation. This filter member 26 has a cross-sectional outline approximately equal to the cross-sectional outline of the holder bore 18. The filter member defines a perimeter which rests on the shoulder section of the lower end portion of each of the holders. The engagement between the perimeter of the filter member and the shoulder of the holders serves to prevent the passage of the filter member through the holder and this positions the filter member in the stream of air drawn into the user's nostril during inhalation.

The spacing of the passages through the filter member are preselected such that the various types of particulate material can be filtered from the ambient atmosphere. For example, for small pollen matters the spacing will be very small to enhance the entrapping feature of the filter medium.

Each of the nostril units includes a filter plug member 30 having a generally cylindrical outline. Each of the plug members defines a passageway 32 therethrough and a first end portion 34. This first end portion 34 is proportioned for being received within the first end portion of the holder to secure the filter member within the holder. More specifically, the perimeter of the filter member 26 is interposed between the first end portion 34 of the filter plug member and the shoulder section 24 of the holder and trapped thereby in a fixed position. In this connection, it is not necessary that the filter member 26 be fabricated of a rigid material or that this filter member have a substantially rigid perimeter inasmuch as it is held in position along its perimeter by the sandwiching effect of the plug and the holder.

Preferably, the first end portion of each of the plug member defines a cross-sectional outline which is substantially equal to the cross-sectional outline of the bore extending through the first end portion of the holder such that the first end portion of the plug is received within the end portion of the holder with a forced fit. Also, the plug member is preferably fabricated from a resilient material to assist in forming a seal with the brim 32 of the nose.

Figure 7:
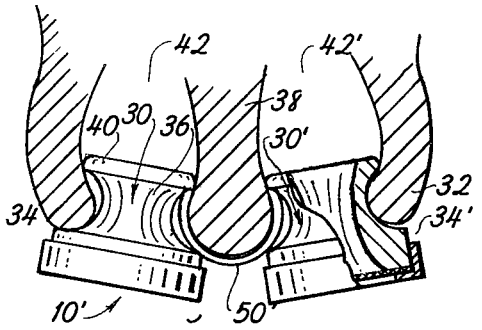
FIG. 7 illustrates a nose filter constructed in accordance with various features of the invention mounted proximate the brim of the nose and including securing means which joins the perspective plug members.
Figure 2:
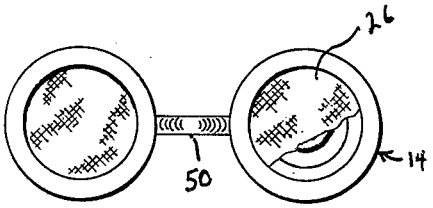
FIG. 2 illustrates a plan view looking at the underside of the filter illustrated in FIG. 1 with a portion of one of the filter members broken away for clarity.

As illustrated in FIG. 7, the plug member 30 defines a body portion 36 having an external wall which is contoured for receiving a portion of the wearer's nose. This contoured body portion assists in forming a seal with the brim 32 of the nose and the septum 38 of the user. The body portion 36 terminates in an end portion 40 which is flared to assist in holding the plug member within the nostril passage 42 of the user and also assists in forming a seal between the internal wall of the nostril and the flared portion of the plug member.

Figure 6:
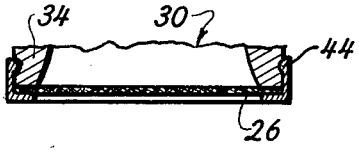
FIG. 6 illustrates a cross-sectional view of a filter holder and filter plug member illustrating a detent for securing the holder and the plug member.

As illustrated in FIG. 6, a detent generally indicated at 44 is provided such that the holder and the plug are releasably secured. More specifically, the portion 20 of the holder is provided with an annular projection which is received within an annular recess in the juxtoposed end portion 34 of the plug member 30.

Securing means generally indicated at 50 in FIG. 1 is provided for joining the first nostril unit 12 and the further nostril unit 14 at a preselected spaced location. Preferably, the securing means 50 serves to bias the first nostril unit towards the further nostril unit such that septum 38 of the nose is anatomically engaged by each of the plug members 30 and 30' such that the filter is releasably mounted in the nose of the user. In the embodiment illustrated in FIG. 1, one end portion of the securing means is joined with the holder 16 and a further end portion of the securing means is joined with the holder 16'. The securing means comprises an arcuate spring member which is adapted for receiving the brim of the septum within its cross-sectional outline when the filter is worn by a user.

In the embodiment illustrated in FIG. 7, the securing means 50' is arcuate and includes one end portion which is joined with the plug member 30 and the further end portion which is joined to plug member 30'. It will be recognized by those skilled in the art, that the opposite end portions of the securing means can be joined with the operatatively associated nostril unit at various locations while simultaneously accomplishing the purposes for which the filter is designed. For example, the opposite end portions of the securing means may be joined with the body portions 36 and 36', respectively, of the plug members.

From the foregoing detailed description, it will be recognized that a nose filter incorporating various advantages of the known prior art has been described and illustrated. For example, the illustrated nose filter is inexpensive to manufacture and may be manufactured in large quantities by relatively expensive plastic molds. Inasmuch as the filter incorporates parts which can be resilient such as the plug members, the filter can be worn by users having various sized noses. As necessary or desired it will, of course, be recognized that the plug members may have various cross-sectional outlines such that the filter may be worn by large or small noses without discomfort. Also, the filter member 26 may be readily inserted and replaced as necessary or desired such that a substitute filter member designed for trapping various size particulate material entrained in the ambient air can be utilized.

While a preferred embodiment has been shown and described, it will be understood that there is no intention to limit the invention by such disclosure, but rather it is intended to cover all modifications and all alternate constructions falling within the spirit and scope of the invention as defined in the appended claims.

I claim:

1. A nose filter for filtering air breathed through the nostrils, said filter comprising:

a first nostril unit for filtering air inhaled through one nostril of user's nose and a further nostril unit for filtering air inhaled through the other nostril of the user's nose, each of said units including a holder having a substantially cylindrical configuration with a bore therethrough, said holder defining a upper end portion and a lower end portion, said lower end portion defining an annular shoulder section such that the bore extending through the lower end portion of said holder has a reduced diameter, a filter member having a cross-sectional outline approximately equal to the cross-sectional outline of the holder bore in said upper portion, said filter member defining a perimeter which rests on the shoulder section of said lower end portion of said holder, a filter plug member having a generally cylindrical outline and defining a passageway therethrough said plug member having a lower end portion slidably mounted within said upper end portion of said holder, said filter member being held in said nostril unit between the lower end of said plug member and said annular shoulder, said plug member further including a body portion having a contoured, external wall for receiving a portion of the nose and an upper end portion, said upper end portion being flared outwardly to assist in holding said plug member within a nostril, and securing means for joining said first nostril unit with said further nostril unit at a preselected spaced location, said securing means serving to bias said first nostril unit towards said further nostril unit such that the septum of the nose is anatomically engaged by said plug member of said first nostril unit and said plug member of said further nostril unit whereby said filter is releasably mounted on the nose of a user.

2. The nose filter of claim 1 wherein each of said holders includes a detent for releasably engaging the lower end portion of the operatively associated plug member.

3. The nose filter of claim 1 wherein each filter member comprises a fibrous material which enables inhalation therethrough, the spacing of said fibers being preselected to filter out pollen and other particulate matter from the air.

4. The nose filter of claim 1 wherein said plug member is fabricated from a resilient material.

5. The nose filter of claim 1 wherein the lower end portion of said plug member defines a cross-sectional outline which is substantially equal to the cross-sectional outline of the bore extending through the upper end portion of said holder, whereby said lower end portion of said plug member is received within the upper end portion of said holder with a forced fit.

6. The nose filter of claim 1 wherein said securing means for joining said first nostril unit with said further nostril unit at a preselected spaced location includes one end portion mounted on said holder of said first nostril unit and a further end portion mounted on said holder of said further nostril unit.

7. The nose filter of claim 1 wherein said securing means for joining said first nostril unit with said further nostril unit at a preselected spaced location includes one end portion secured to said plug member of said first nostril unit and a further end portion secured to said plug member of said further nostril unit.

8. The nose filter of claims 1 or 7 wherein said securing means comprises an arcuate spring member adapted for receiving the brim of the septum within its cross-sectional outline.

* * * * *